US008840238B2

(12) United States Patent
Liu

(10) Patent No.: US 8,840,238 B2
(45) Date of Patent: Sep. 23, 2014

(54) SYSTEMS AND METHODS FOR INK-BASED DIGITAL PRINTING USING IMAGING MEMBER AND IMAGE TRANSFER MEMBER

(75) Inventor: Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 98 days.

(21) Appl. No.: 13/599,380

(22) Filed: Aug. 30, 2012

(65) Prior Publication Data

US 2014/0063161 A1 Mar. 6, 2014

(51) Int. Cl.
*B41J 2/01* (2006.01)

(52) U.S. Cl.
USPC ..... 347/103

(58) Field of Classification Search
None
See application file for complete search history.

(56) References Cited

U.S. PATENT DOCUMENTS

2012/0103221 A1* 5/2012 Stowe et al. ..... 101/483

* cited by examiner

*Primary Examiner* — Geoffrey Mruk
(74) *Attorney, Agent, or Firm* — Ronald E. Prass, Jr.; Prass LLP

(57) ABSTRACT

Ink-based digital printing systems useful for ink printing include an imaging member configured to receive a layer of dampening fluid, and configured to absorb light energy emitted by a laser imager; and a transfer member configured to receive ink, the transfer member and the imaging member forming a dampening fluid image loading nip. Systems include a dampening fluid metering system configured to form a uniform layer of dampening fluid onto a surface of the imaging member, and a laser imager, the laser imager configured to expose a layer of dampening fluid on the imaging member to a laser beam for selectively evaporating portions of the dampening fluid layer to form a dampening fluid image. Systems may include the transfer member being configured to receive a dampening fluid image from a surface of the imaging member at the dampening fluid image loading nip.

16 Claims, 2 Drawing Sheets

SYSTEMS AND METHODS FOR INK-BASED DIGITAL PRINTING USING IMAGING MEMBER AND IMAGE TRANSFER MEMBER

RELATED APPLICATIONS

This application is related to co-pending U.S. application Ser. No. 13/599,004, titled SYSTEMS AND METHODS FOR INK-BASED DIGITAL PRINTING USING DAMPENING FLUID IMAGING MEMBER AND IMAGE TRANSFER MEMBER, the disclosure of which is incorporated herein in its entirety.

FIELD OF DISCLOSURE

The disclosure relates to ink-based digital printing. In particular, the disclosure relates to methods and systems for ink-based digital printing with a printing system having an imaging member and an image transfer member that receives a dampening fluid image from the imaging member.

BACKGROUND

Related art ink-based digital printing systems, or variable data lithography systems configured for digital lithographic printing, include an imaging system for laser patterning a layer of dampening fluid applied to an imaging member. The imaging system includes a high power laser for emitting light energy. The imaging member must include a costly reimageable surface layer, such as a plate or blanket that is capable of absorbing light energy, among other demands required for image production. While high print speeds and reduced system and operating costs are generally desirable, print speeds achieved using related art ink-based digital printing systems are limited by the laser imaging process.

SUMMARY

Related art ink-based digital printing system use high power lasers for laser patterning that require an imaging member having a plate that is costly and subject to stringent design requirements, including suitability for dampening fluid and ink interactions. Systems are desired for metering dampening fluid onto an imaging member, patterning dampening fluid according to image data using a laser imager, and transferring the dampening fluid image to a separate member for inking.

In an embodiment, ink-based digital printing systems useful for ink printing may include an imaging member configured to receive a layer of dampening fluid, and configured to absorb light energy emitted by a laser imager; and a transfer member configured to receive ink, the transfer member and the imaging member forming a dampening fluid image loading nip. Systems may include a dampening fluid metering system configured to form a uniform layer of dampening fluid onto a surface of the imaging member.

In an embodiment, systems may include a laser imager, the laser imager configured to expose a layer of dampening fluid on the imaging member to a laser beam for selectively evaporating portions of the dampening fluid layer to form a dampening fluid image. Systems may include the laser imager being configured to expose the dampening fluid according to image data. Systems may include the transfer member being configured to receive a dampening fluid image from a surface of the imaging member at the transfer nip. Systems may include the imaging member further including an IR absorptive surface.

In an embodiment, system may include the dampening fluid system and the imaging member being configured for forming a layer of dampening fluid on the imaging member having a thickness of about 1 micrometer. The transfer member may include a conformable surface. The surface may comprise, for example, silicone. In an embodiment, the imaging member and the transfer member each may have a textured surface. In an embodiment, systems may include an inker configured for applying ink to a surface of the transfer member after the transfer member receives a dampening fluid image transferred from the imaging member for forming an ink image based on the dampening fluid image.

An embodiment of methods for ink-based digital printing may include metering a layer of dampening fluid onto a surface of an imaging member; selectively exposing the layer of dampening fluid to radiation form a dampening fluid image according to image data; and transferring the dampening fluid pattern to a transfer member at a dampening fluid pattern loading nip defined by the transfer member and the imaging member. Methods may include applying ink to a surface of the transfer member having the dampening fluid image to produce an ink image.

In an embodiment, methods may include conditioning the ink image to increase a viscosity of the ink before transfer of the ink image to a substrate. Methods may include transferring the ink image to a substrate at an ink image transfer nip defined by the transfer member and a substrate transport system. Methods may include applying heat and air flow to the surface of the imaging member to evaporate dampening fluid remaining on a surface of the imaging member after dampening fluid image transfer. Methods may include the selectively exposing further comprising outputting a laser beam from a laser imager. In an embodiment, methods may include removing ink remaining on the surface of the transfer member after the transferring the ink pattern.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
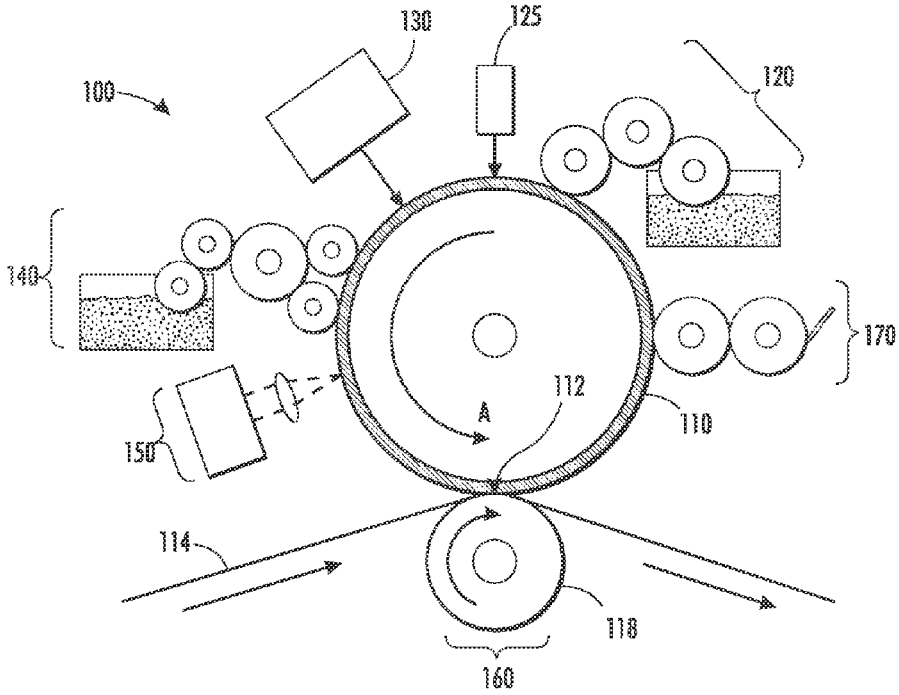
FIG. 1 RELATED ART
FIG. 1 shows a diagrammatical view of a related art digital architecture printing system.

Exemplary embodiments are intended to cover all alternatives, modifications, and equivalents as may be included within the spirit and scope of the apparatus and systems as described herein.

Reference is made to the drawings to accommodate understanding of systems and methods for ink-based digital printing using an imaging member and a transfer member. In the drawings, like reference numerals are used throughout to designate similar or identical elements. The drawings depict various embodiments of illustrative systems and methods for ink-based digital printing using an imaging member and a transfer member.

Related art ink-based digital printing systems that use high power lasers for laser patterning dampening fluid on an imaging plate can be costly and have limited print speeds. U.S. patent application Ser. No. 13/095,714 (the 714 application), which is commonly assigned and the disclosure of which is incorporated by reference herein in its entirety, proposes systems and methods for providing variable data lithographic and offset lithographic printing or image receiving medium marking. The systems and methods disclosed in the 714 application are directed to improvements on various aspects of previously-attempted variable data imaging lithographic marking concepts based on variable patterning of dampening fluids to achieve effective truly variable digital data lithographic printing.

According to the 714 application, a reimageable surface is provided on an imaging member, which may be a drum, plate, belt or the like. The reimageable surface may be composed of, for example, a class of materials commonly referred to as silicones, including polydimethylsiloxane (PDMS) among others. The reimageable surface may be formed of a relatively thin layer over a mounting layer, a thickness of the relatively thin layer being selected to balance printing or marking performance, durability and manufacturability.

The 714 application describes an exemplary variable data lithography system 100 for ink-based digital printing, such as that shown, for example, in FIG. 1. A general description of the exemplary system 100 shown in FIG. 1 is provided here. Additional details regarding individual components and/or subsystems shown in the exemplary system 100 of FIG. 1 may be found in the 714 application.

As shown in FIG. 1, the exemplary system 100 may include an imaging member 110. The imaging member 110 in the embodiment shown in FIG. 1 is a drum, but this exemplary depiction should not be interpreted so as to exclude embodiments wherein the imaging member 110 includes a plate or a belt, or another now known or later developed configuration. The imaging member 110 is used to apply an ink image to an image receiving media substrate 114 at a transfer nip 112. The transfer nip 112 is formed by an impression roller 118, as part of an image transfer mechanism 160, exerting pressure in the direction of the imaging member 110. Image receiving medium substrate 114 should not be considered to be limited to any particular composition such as, for example, paper, plastic, or composite sheet film. The exemplary system 100 may be used for producing images on a wide variety of image receiving media substrates. The 714 application also explains the wide latitude of marking (printing) materials that may be used, including marking materials with pigment densities greater than 10% by weight. As does the 714 application, this disclosure will use the term ink to refer to a broad range of printing or marking materials to include those which are commonly understood to be inks, pigments, and other materials which may be applied by the exemplary system 100 to produce an output image on the image receiving media substrate 114.

The 714 Application depicts and describes details of the imaging member 110 including the imaging member 110 being comprised of a reimageable surface layer formed over a structural mounting layer that may be, for example, a cylindrical core, or one or more structural layers over a cylindrical core. The exemplary system 100 includes a dampening fluid subsystem 120 generally comprising a series of rollers, which may be considered as dampening rollers or a dampening unit, for uniformly wetting the reimageable surface of the imaging member 110 with dampening fluid. A purpose of the dampening fluid subsystem 120 is to deliver a layer of dampening fluid, generally having a uniform and controlled thickness, to the reimageable surface of the imaging member 110. As indicated above, it is known that the dampening fluid may comprise mainly water optionally with small amounts of isopropyl alcohol or ethanol added to reduce surface tension as well as to lower evaporation energy necessary to support subsequent laser patterning, as will be described in greater detail below. If the dampening fluid is a fountain solution, small amounts of certain surfactants may be added to the fountain solution. Alternatively, other suitable dampening fluids may be used to enhance the performance of ink based digital lithography systems. Suitable dampening fluids are disclosed, by way of example, in co-pending U.S. patent application Ser. No. 13/284,114, titled DAMPENING FLUID FOR DIGITAL LITHOGRAPHIC PRINTING, the disclosure of which is incorporated herein by reference in its entirety.

Once the dampening fluid is metered onto the reimageable surface of the imaging member 110, a thickness of the dampening fluid may be measured using a sensor 125 that may provide feedback to control the metering of the dampening fluid onto the reimageable surface of the imaging member 110 by the dampening fluid subsystem 120.

Once a precise and uniform amount of dampening fluid is provided by the dampening fluid subsystem 120 on the reimageable surface of the imaging member 110, and optical patterning subsystem 130 may be used to selectively form a latent image in the uniform dampening fluid layer by imagewise patterning the dampening fluid layer using, for example, laser energy. Typically, the dampening fluid will not absorb the optical energy (IR or visible) efficiently. The reimageable surface of the imaging member 110 should ideally absorb most of the laser energy (IR or visible) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being a laser emitter, it should be understood that a variety of different systems may be used to deliver the optical energy to pattern the dampening fluid.

The mechanics at work in the patterning process undertaken by the optical patterning subsystem 130 of the exemplary system 100 are described in detail with reference to FIG. 5 in the 714 application. Briefly, the application of optical patterning energy from the optical patterning subsystem 130 results in selective evaporation of portions of the layer of dampening fluid.

Following patterning of the dampening fluid layer by the optical patterning subsystem 130, the patterned layer over the reimageable surface of the imaging member 110 is presented to an inker subsystem 140. The inker subsystem 140 is used to apply a uniform layer of ink over the layer of dampening fluid and the reimageable surface layer of the imaging member 110. The inker subsystem 140 may use an anilox roller to meter an offset lithographic ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink on the unformatted portions of the dampening fluid will not adhere to those portions.

The cohesiveness and viscosity of the ink residing in the reimageable layer of the imaging member 110 may be modified by a number of mechanisms. One such mechanism may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening fluid may also wet substrate 114, the volume of such a dampening fluid will be minimal, and will rapidly evaporate or be absorbed by the substrate 114.

In certain offset lithographic systems, it should be recognized that an offset roller, not shown in FIG. 1, may first receive the ink image pattern and then transfer the ink image pattern to a substrate according to a known indirect transfer method.

Following the transfer of the majority of the ink to the substrate 114, any residual ink and/or residual dampening fluid must be removed from the reimageable surface of the imaging member 110, preferably without scraping or wearing that surface. An air knife 175 may be employed to remove residual dampening fluid. It is anticipated, however, that some amount of ink residue may remain. Removal of such remaining ink residue may be accomplished through use of some form of cleaning subsystem 170. The 714 application describes details of such a cleaning subsystem 170 including at least a first cleaning member such as a sticky or tacky member in physical contact with the reimageable surface of the imaging member 110, the sticky or tacky member removing residual ink and any remaining small amounts of surfactant compounds from the dampening fluid of the reimageable surface of the imaging member 110. The sticky or tacky member may then be brought into contact with a smooth roller to which residual ink may be transferred from the sticky or tacky member, the ink being subsequently stripped from the smooth roller by, for example, a doctor blade.

The 714 application details other mechanisms by which cleaning of the reimageable surface of the imaging member 110 may be facilitated. Regardless of the cleaning mechanism, however, cleaning of the residual ink and dampening fluid from the reimageable surface of the imaging member 110 is essential to preventing ghosting in the proposed system. Once cleaned, the reimageable surface of the imaging member 110 is again presented to the dampening fluid subsystem 120 by which a fresh layer of dampening fluid is supplied to the reimageable surface of the imaging member 110, and the process is repeated.

According to the above proposed structure, variable data digital lithography has attracted attention in producing truly variable digital images in a lithographic image forming system. The above-described architecture combines the functions of the imaging plate and potentially a transfer blanket into a single imaging member 110 that must have a light absorptive surface.

Related art ink-based digital printing systems having a high power imaging laser are costly. The high power laser imager is costly, and the imaging member must include a costly reimageable plate or surface layer that is capable of absorbing light energy and is subject to numerous other design constraints. For example, a related art imaging member must include a re-imageable plate, blanket, or surface layer that is capable of absorbing light energy. The related art imaging plate must satisfy requirements including: enabling inking and release of an ink image; conformability for facilitating transfer of ink images to a wide variety of substrates; temperature tolerance; capable of IR absorption by incorporating, for example, carbon or iron oxide such as iron (III) oxides; enabling surface wetting suitable for ink/plate/dampening fluid interactions; having suitable surface texture configured for pinning of dampening fluid after laser imaging or patterning; capable of maintaining the above requirements and spatial uniformity for prolonged periods of time, e.g., tens of thousands of impressions or longer.

In particular, a related art imaging plate must be 1) configured to accept ink from an inker and enable nearly 100% release of the accepted ink at an ink transfer nip. The imaging member must be 2) conformable for enabling printing on a variety of substrates including paper, plastics, and substrates suitable for packaging. The imaging plate must be 3) configured to tolerate temperatures of greater than 200° C. to accommodate laser patterning. The imaging plate must be 4) configured to absorb IR light, and may incorporate carbon black or ferric oxide in a body of the plate. For example, to minimize absorption depth, the concentration of IR absorber should be high, e.g., 10%. The imaging plate must be 5) configured for surface wetting for dampening fluid, ink, and plate interactions; and the imaging plate must be 6) configured to have a surface texture.

A dampening fluid image, after laser patterning, is unstable. Due to the fluid nature of the dampening fluid, the surface tension of the fluid tends to reshape the edges/corners of the pockets after the removal of the dampening fluid by the laser power. As a result, an image defect known as pull-back (excessive edge reshaping after laser patterning) can occur and image resolution and image fidelity are reduced. A fine surface texture is important for pinning dampening fluid—after laser patterning. This is particularly challenging during laser exposure when the dampening fluid is subject to an extreme temperature gradient. Additionally, surface texture is important for the inking process. A smooth plate surface without texture may cause various solid and halftone uniformity problems. Plasma etching of the plate surface has been identified as a suitable texturing method. Plasma etching is not, however, effective for all materials. Further, plasma etching can expose the IR absorber embedded in the plate The imaging plate must 7) satisfy miscibility requirements between the imaging plate and various chemical components in the dampening fluid and ink. The imaging plate must be 8) wear resistant, maintaining requirements 1-7 enumerated above over a long period of time. This is difficult at least because many of requirements 1-7 related to surface properties of the plate, which is subject to constant heating and pressure cycles. Failure modes include surface wear, leaching of IR absorber from the imaging plate bulk through the surface of the plate, etc.

Systems and methods of embodiments divide imaging plate functionality between two distinct physical members: an imaging member and a transfer member. The imaging member and the transfer member may be rolls or cylinders. The imaging member may be configured in a printing system to receive dampening fluid from a dampener. After dampening fluid is metered onto surface of the imaging member, laser energy is applied to the dampening fluid layer for patterning the dampening fluid according to image data to form a dampening fluid image or pattern. In particular, the dampening fluid is evaporated by laser energy.

The imaging member may then be brought into contact with a transfer member that receives the laser-patterned dampening fluid image. The imaging member and the transfer member may define a dampening fluid image (or pattern) loading nip for contact transfer/splitting of the dampening fluid image from the imaging member to the transfer member. At the loading nip, a region of the surface of the imaging member soaked with dampening fluid may be damp, and upon contacting the transfer member, will release a small amount of dampening fluid for transfer to the surface of the transfer member. Ink-based digital printing systems and methods in accordance with embodiments enable reduced risks and costs associated with developing imaging member material sets that satisfy all of IR absorption, dampening fluid, and ink requirements. Further, systems and methods enable improved image quality, print speed, and reduced waste.

The imaging member is subject to above-enumerated plate requirements 3 and 4, and variations of requirements 5-7. For example, with regard to requirement 5), the imaging member need only accommodate interaction between the dampening fluid and the imaging member. With regard to 6), the surface texture need only be configured for dampening fluid and, e.g., pullback thereof. This may be achieved through the selection of hard and durable imaging member surface, for example, ceramic materials. With regard to 7) the imaging member need only be configured to accommodate the interaction between the dampening fluid and the imaging member. Further, the imaging member may be run at constant elevated temperatures, reducing laser imager power requirements, and improving print speed The transfer member is subject to above-enumerated requirements 1, 2, and 5, and variations of requirements 6-8. For example, with regard to requirement 6) the surface of the transfer member may be textured for inking if necessary. Some inks do not require texturing, and can work on a surface without texture. With regard to requirement 7), the interaction between the transfer member and dampening fluid is reduced, and as such the difficulty in meeting this requirement is reduced. With regard to requirement 8), it is easier to achieve without the need to meet requirements 3-4. Some failure modes are eliminated, such as leaching of IR absorber from the bulk of the imaging plate—the transfer member does not require IR absorptive material.

Figure 2:
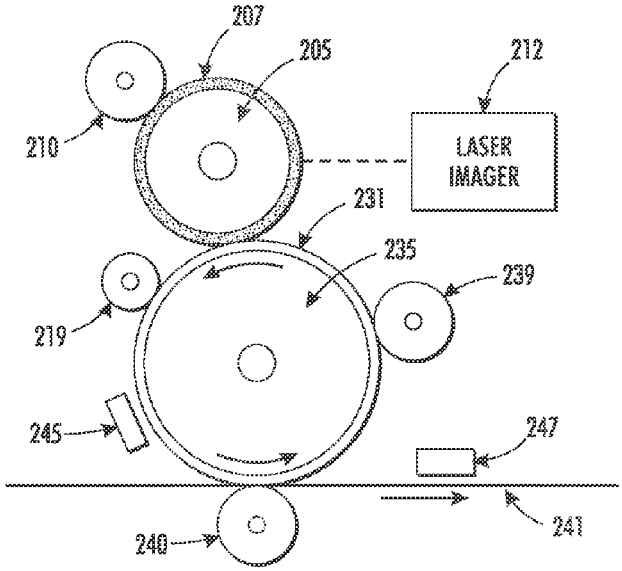
FIG. 2 shows a ink-based digital printing system in accordance with an embodiment.

FIG. 2 shows an ink-based digital printing system in accordance with an embodiment. In particular, FIG. 2 shows an imaging member 205. The imaging member 205 includes an IR absorptive material in or under its surface 207. Preferably, the imaging member surface 207 is configured to absorb IR light without leaching of IR absorptive materials, which may include ferric oxide or carbon black.

Systems may include a dampening fluid metering system 210. The dampening fluid metering system 210 may be configured for metering a uniform layer of dampening fluid onto a surface 207 of the imaging member 205. Systems may include a laser imager 212 configured for emitting a laser beam, and selectively applying the laser beam to a layer of dampening fluid on a surface 207 of the imaging member 205. The laser beam may be applied according to image data for patterning the dampening fluid by evaporating dampening fluid at desired areas of the dampening fluid layer.

A transfer member 235 may be configured to form a dampening fluid image loading nip with the imaging member 205 such that a dampening fluid image produced by laser patterning on a region of the imaging member surface 207 is transferred to a transfer member surface 231 under pressure at the loading nip. In particular, a light pressure may be applied between the transfer member surface 231 and the imaging member surface 207. At the dampening fluid image loading nip, the dampening fluid image splits under pressure, and transfer an amount of dampening fluid to the transfer member 235, forming the dampening fluid image patterned by the laser imager 212 on the surface 231 of the transfer member 235. The amount of dampening fluid transferred may be adjusted by contact pressure adjustments. For example, a dampening fluid layer of about 1 micrometer or less may be transferred to the transfer member surface 231.

After the dampening fluid image is transferred to the transfer member 235, ink from an inker 219 is applied to a transfer member surface 231 to form an ink pattern or image. The ink pattern or image may be a negative of or may correspond to the dampening fluid pattern. The ink image may be transferred to media at an ink image transfer nip formed by the transfer member 235 and a substrate transport roll 240. The substrate transport roll 240 may urge a paper transport 241, for example, against the transfer member surface 231 to facilitate contact transfer of an ink image from the transfer member 235 to media carried by the paper transport 241.

Systems may include a rheological conditioning system 245 for increasing a viscosity of ink of an ink image before transfer of the ink image at the ink image transfer nip. Systems may include a curing system 247 for curing an ink image on media after transfer of the ink image from the transfer member 235 to media carried by the paper transport 241, for example. The rheological conditioning system 245 may be positioned before a transfer member nip, with respect to a media process direction. The curing system 247 may be positioned after a transfer member 235, with respect to a media process direction. After transfer of the ink image from the transfer member 235 to the media, residual ink may be removed by a transfer member cleaning system 239.

After transfer of the dampening fluid pattern from the imaging member surface 207, the imaging member 205 may be cleaned in preparation for a new cycle. Various methods for cleaning the imaging member surface 207 may be used.

Figure 3:
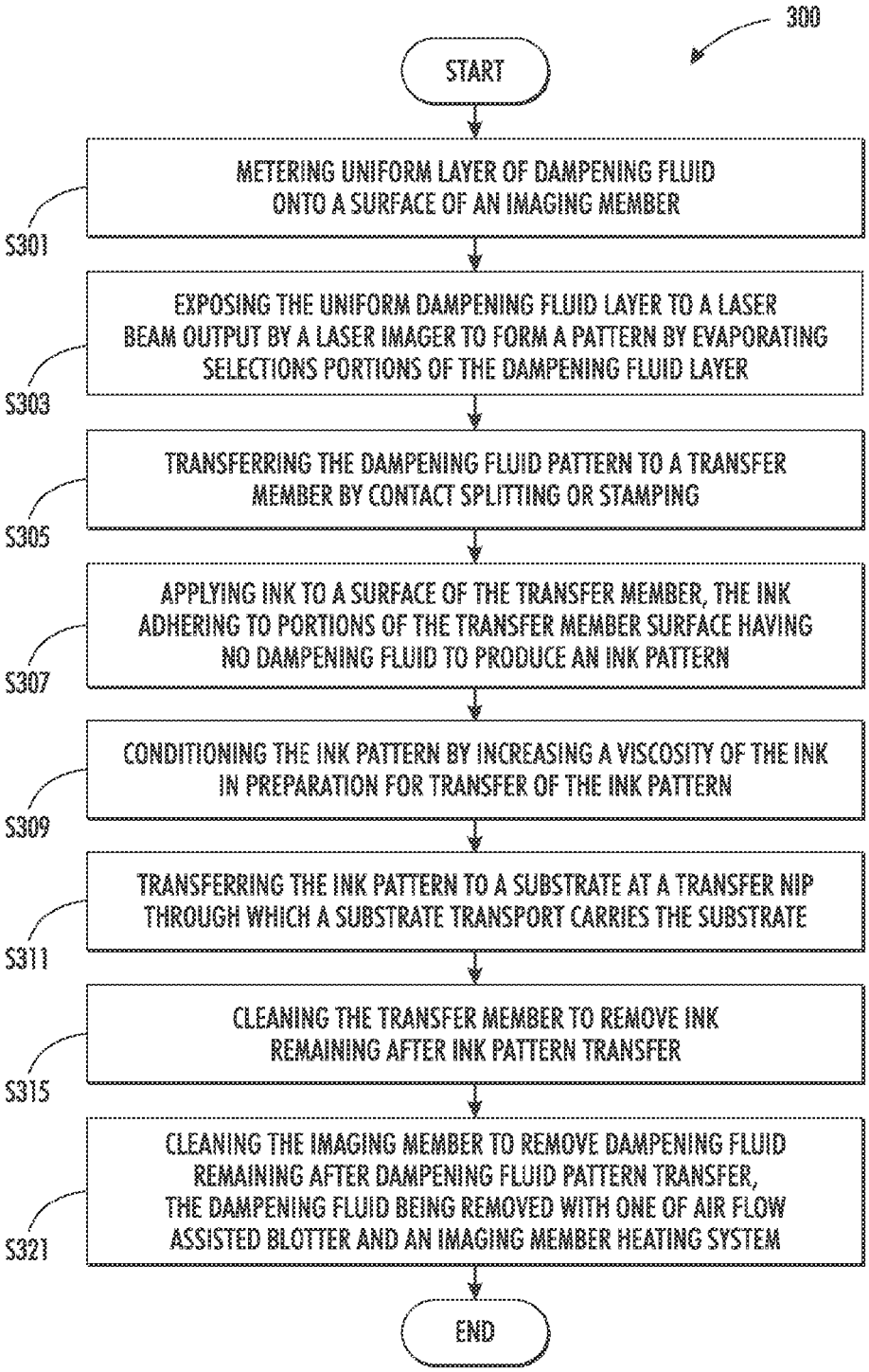
FIG. 3 shows an ink-based digital printing method in accordance with an embodiment.

FIG. 3 shows methods for ink-based digital printing in accordance with an embodiment. In particular, FIG. 3 shows an ink-based digital printing process 300. Methods may include applying dampening fluid onto an imaging member surface using a dampener to form a uniform layer of dampening fluid on the imaging member at S301. Methods may include exposing the dampening fluid layer to a laser beam output by a laser imaging system at S303. The dampening fluid may be exposed to the laser beam according to image data for patterning the dampening fluid. As desired portions of the dampening fluid layer are exposed to laser energy, the desired portions of dampening fluid absorb energy output by the laser, and evaporate from the imaging member surface, leaving a dampening fluid pattern or image.

Methods may include transferring the dampening fluid pattern or image at S305 to a transfer member. In particular, the dampening fluid image may be transferred under pressure at a dampening fluid image loading nip formed by the imaging member and the transfer member. The dampening fluid image may be split, stamped, or contact transferred to the transfer member from the imaging member at the loading nip at S305.

Methods may include inking a surface of the transfer member at S307. The ink may adhere to portions of the transfer member surface having no dampening fluid, to produce an ink pattern or image. Methods may include rheological conditioning of the ink image at S309. The ink image may be conditioned to increase a viscosity of the ink in preparation for effective transfer of the ink image at a pressure nip formed by the transfer member and a substrate transport roll. In particular, methods may include pre-curing the ink image before transfer of the ink image to a substrate such as paper or packaging.

Methods may include transferring the ink image from the transfer member to a substrate at S311. In particular, the ink may be transferred to a substrate such as a paper carried by a substrate transport path. The substrate transport path may be configured to carry a substrate through the transfer nip formed by the transfer member and the substrate transport roll. Methods may include cleaning the transfer member at S315 to remove ink remaining after ink pattern or image transfer from the transfer roll to the substrate. Methods may include cleaning the imaging member at S321. In particular, the imaging member may be cleaned by a cleaning system configured to remove dampening fluid remaining on the imaging member surface after transfer of a dampening fluid image from the imaging member to the transfer member at S305.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An ink-based digital printing system useful for ink printing, comprising:

an imaging member configured to receive a layer of dampening fluid, and configured to absorb light energy emitted by a laser imager for laser patterning the dampening fluid layer to form a dampening fluid image;

a transfer member, the transfer member and the imaging member forming a dampening fluid image loading nip for transferring the dampening fluid image to from the imaging member to the transfer member; and an inker, the inker being configured to apply ink to a surface of the transfer member having the dampening fluid image disposed thereon to form an ink image based on the dampening fluid image.

2. The system of claim 1, comprising:

a dampening fluid metering system configured to form a uniform layer of dampening fluid onto a surface of the imaging member.

3. The system of claim 2, the laser imager being configured to expose the dampening fluid according to image data.

4. The system of claim 2, the transfer member being configured to receive a dampening fluid image from a surface of the imaging member at the transfer nip.

5. The system of claim 1, comprising:

a laser imager, the laser imager configured to expose a layer of dampening fluid on the imaging member to a laser beam for selectively evaporating portions of the dampening fluid layer to form a dampening fluid image.

6. The system of claim 1, the imaging member further comprising:

an IR absorptive surface.

7. The system of claim 6, the dampening system and the imaging member being configured for forming a layer of dampening fluid on the imaging member having a thickness of about 1 micrometer.

8. The system of claim 1, the transfer member further comprising the surface being conformable.

9. The system of claim 1, the transfer member further comprising:

a silicone surface.

10. The system of claim 1, the imaging member and the transfer member each having a textured surface.

11. The system of claim 1, comprising:

a substrate transport system; and an ink image transfer nip, the ink image transfer nip being defined by the transfer member and the substrate transport system.

12. A method for ink-based digital printing, comprising:

metering a layer of dampening fluid onto a surface of an imaging member;

selectively exposing the layer of dampening fluid to radiation form a dampening fluid image according to image data;

transferring the dampening fluid pattern to a transfer member at a dampening fluid pattern loading nip defined by the transfer member and the imaging member;

applying ink to a surface of the transfer member having the dampening fluid image to produce an ink image; and transferring the ink image to a substrate at an ink image transfer nip defined by the transfer member and a substrate transport system.

13. The method of claim 12, comprising: conditioning the ink image to increase a viscosity of the ink before transfer of the ink image to a substrate.

14. The method of claim 12, comprising:

applying heat and air flow to the surface of the imaging member to evaporate dampening fluid remaining on a surface of the imaging member after dampening fluid image transfer.

15. The method claim 12, the selectively exposing further comprising outputting a laser beam from a laser imager.

16. The method of claim 12, comprising: removing ink remaining on the surface of the transfer member after the transferring the ink pattern.

* * * * *